United States Patent [19]

Crocoli

[11] Patent Number: 4,803,930

[45] Date of Patent: Feb. 14, 1989

[54] TABLES BOLTED TO A WALL

[76] Inventor: Pietro Crocoli, Via Filippo Serafini 33, Roma, Italy

[21] Appl. No.: 876,091

[22] Filed: Jun. 19, 1986

[30] Foreign Application Priority Data

Jun. 20, 1985 [IT] Italy ..... 48250 A/85

[51] Int. Cl.[4] ..... A47B 5/00

[52] U.S. Cl. ..... 108/48; 108/117; 108/42

[58] Field of Search ..... 108/48, 47, 40, 42, 108/134, 135, 90, 93, 97, 99, 117, 120

[56] References Cited

U.S. PATENT DOCUMENTS

| | | | |
|---|---|---|---|
| 1,208,885 | 12/1916 | Alderman | 108/48 X |
| 1,887,102 | 11/1932 | Mathie | 108/47 X |
| 1,909,093 | 5/1933 | Buffelen | 108/48 X |
| 2,226,735 | 12/1940 | Miller et al. | 108/48 X |
| 3,257,933 | 6/1966 | Baylinson | 108/48 X |
| 3,636,892 | 1/1972 | Linton | 108/48 X |
| 3,680,942 | 8/1972 | Davis | 108/48 X |
| 4,313,385 | 2/1982 | Fitzgerald | 108/48 X |
| 4,337,709 | 7/1982 | Nicholson | 108/42 X |
| 4,452,151 | 1/1984 | Jarrard | 108/42 X |
| 4,501,457 | 2/1985 | Pond | 108/48 X |

FOREIGN PATENT DOCUMENTS

| | | | |
|---|---|---|---|
| 108238 | 10/1967 | Denmark | 108/48 |
| 1449874 | 4/1966 | France | 108/48 |
| 2466217 | 4/1981 | France | 108/48 |
| 251850 | 4/1948 | Switzerland | 108/48 |
| 2064949 | 6/1981 | United Kingdom | 108/48 |

*Primary Examiner*—Kenneth J. Dorner
*Assistant Examiner*—José V. Chen
*Attorney, Agent, or Firm*—Thomas R. Morrison

[57] ABSTRACT

A table having at least three legs and being bolted to a wall. Two of the legs are disposed on a first side of the table, and at least one leg is disposed in a second, opposite, side of the table. The at least one leg is disposed in a track which may be positioned within the table, and the ends of the table are anchored to an adaptable wall fitting. Each leg may either be a unitary piece, or may be divided lengthwise into two reciprocally adjustable or fixable parts, which parts are slidably with respect to one another. A slot is disposed adjacent a first end of a leg, the first end being near the track. A first pivot is mounted to a slide disposed within the slot, the slide being movable along the slot. When the leg is released from an operative position, the pivot permits an angular movement of the leg in an upward direction without undue rotation thereof. A second end of the leg, opposite the first end thereof, is capable of coupling with anchored fittings fixed to the floor in predetermined positions beneath the table. Second and third pivots, separated by the width of a connecting hook, are joined to a wall fitting. The second pivot is disposed within a slot in the wall fitting, and the third pivot, when hooked to the second pivot, rests on an inner surface of the hook. The hook may be movable within its own track, thereby permitting transverse movement of the table from where the hook is attached to the wall. Additional hooks may be added at predetermined places along a slide.

6 Claims, 4 Drawing Sheets

TABLES BOLTED TO A WALL

Demand for more efficient use of space in living environments and in particular in cramped environments, such as trailers, campers, boats and the like is always pressing, and therefore maximum use of space is essential.

In such areas the space occupied by a table while in use must frequently be available at other times for other purposes, by removing the table and using the floor space at different levels.

For example, in the space utilized as a living space in the aforementioned types of vehicles, the table may be removed when being used in said space, and put at a certain location between sofas to be used as a dining table or card table, and can be used between the sofas as a tea table or the base of the bed.

The table is, on the other hand, fixed on one side against the wall where it has been installed, and is placed parallel to or alongside the same wall depending on its use. This usage limits the lengthwise extension of the table because of its being fixed against the wall, the table being used vertically, the maximum length can be determined.

Another problem with the table actually being used is that it must stay fixed to the wall and cannot be used in other spaces, for example, in the open air.

The improvement of tables bolted to walls is the subject of this present invention which is first and foremost based on a system of fixing the table to the wall and how its legs are attached and how they can be made to disappear inside or under the table, e.g. made to go both vertically or horizontally, and also that they can be made of various lengths.

As per the improvements, subject of this invention, each table has three legs, two on one side, the third one on the opposite side, each set within a sheath or a track, or if not, within the table thickness and everything being attached by fasteners at one end to an already determined wall fitting, each leg being of one piece, or two longitudinally divided pieces which are both reciprocally adjustable and fixable and which are also relatively slidable. The end of the leg nearest the sheath has a slot or connecting link which receives a fastener on a slide inside the sheath or track. This fastener is able to slide in the slot the leg being detached from the sheath, and allowing an angulation of the leg in an upward movement without undesirably rotation of the leg.

A terminal with related couplings fixed at the free end of the leg is forms anchored fittings. Two pivots having axles separated by the width of connecting hooks are joined to the wall fitting. A first pivots is disposed inside a slot on the wall fitting. The second pivot, while in use, rests on the inside surface of the hook. The fastener of the wall fitting is movable within a track, permitting transverse table movements from where the hook is attached to the wall. Other fasteners may be added at predetermined locations on one slide.

This and other characteristics may be understood very well by reading the following list with reference to the designs annexed hereto:

Figure 20:
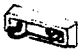
Figure 26:
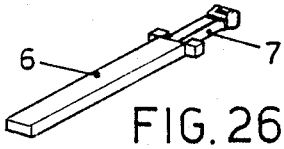
Figure 23:
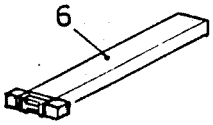
Figure 21:
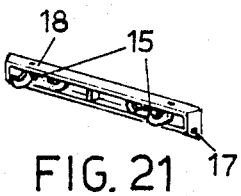

FIGS. 20 and 21 respectively show a wall support for a single size table, fixed with an extending device, and for the double, sliding, with an extending device.

Figure 1:
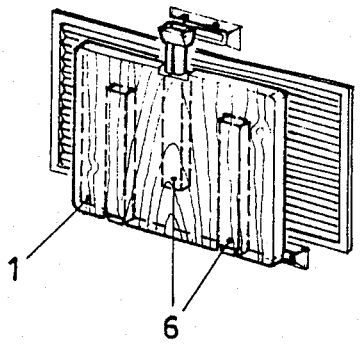
FIG. 1 shows a table fastened to the wall and vertically folded.
Figure 2:
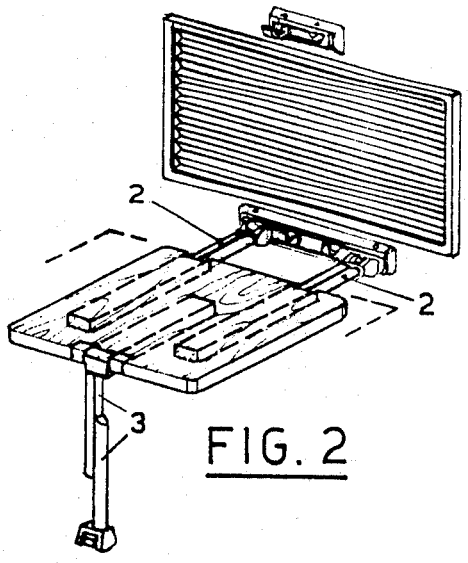
FIG. 2 shows the same table folded horizontally and slightly separated from the wall to which it is fastened.
Figure 3:
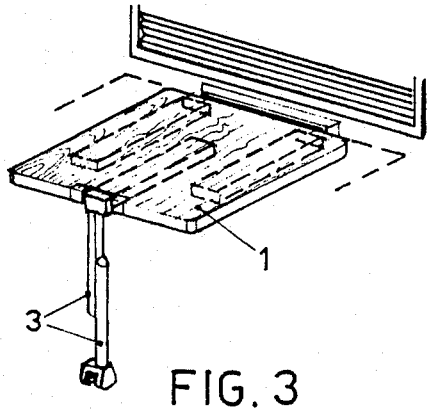
FIG. 3 shows the table in use hooked to the sliding track which is fixed to the wall.
Figure 4:
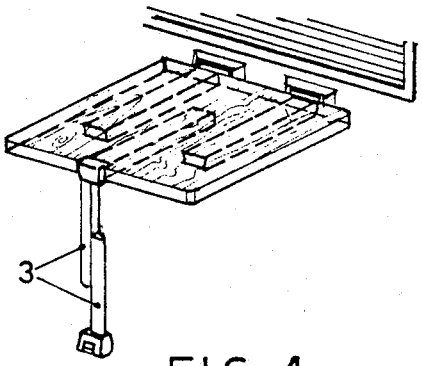
FIG. 4 shows the table in use hooked to two fixed wall anchors.
Figure 5:
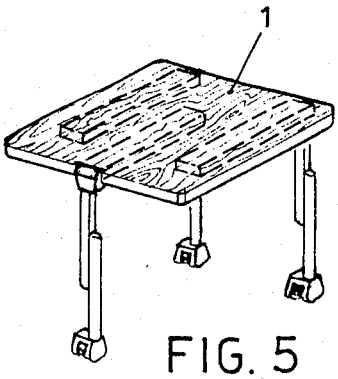
FIG. 5 shows the table in use, released from the wall and at a distance from it.
Figure 6:
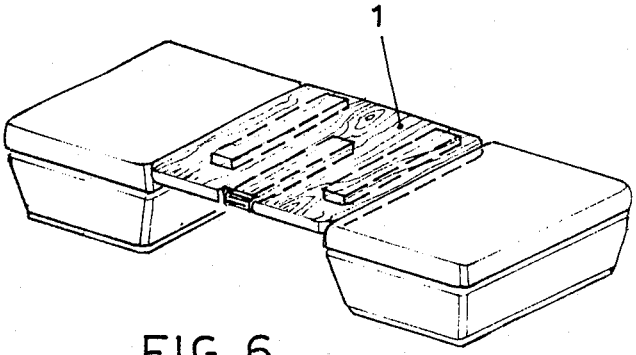
FIG. 6 shows the table in use as the base of a bed.
Figure 7:
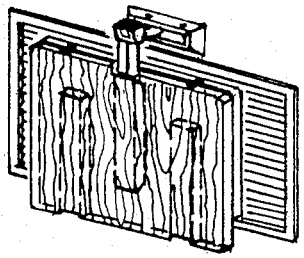
FIGS. 7 to 12 show similar views as previously described, but with a table of double proportions.
Figure 8:
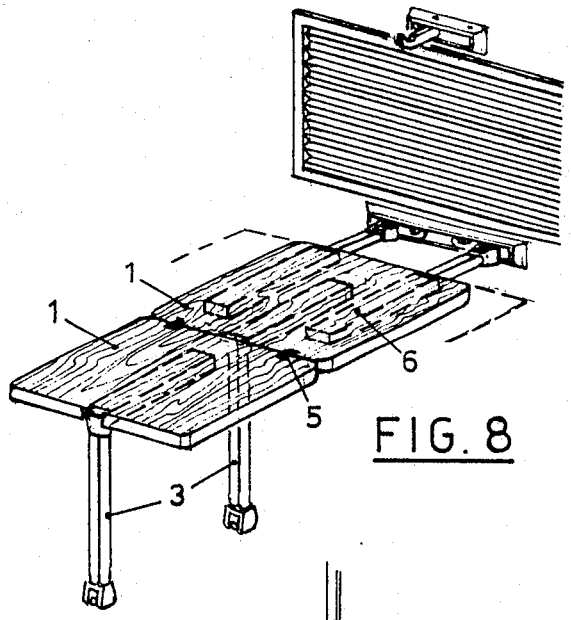
Figure 9:
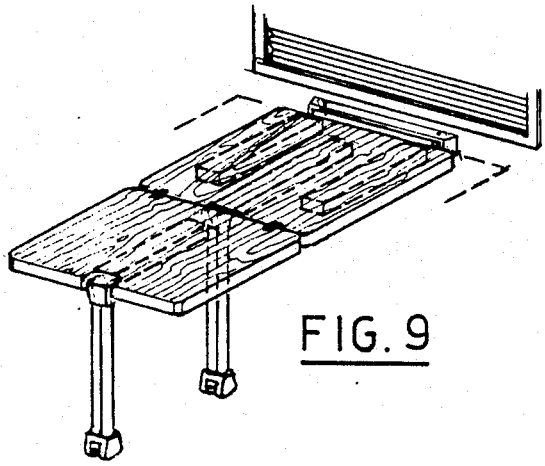
Figure 10:
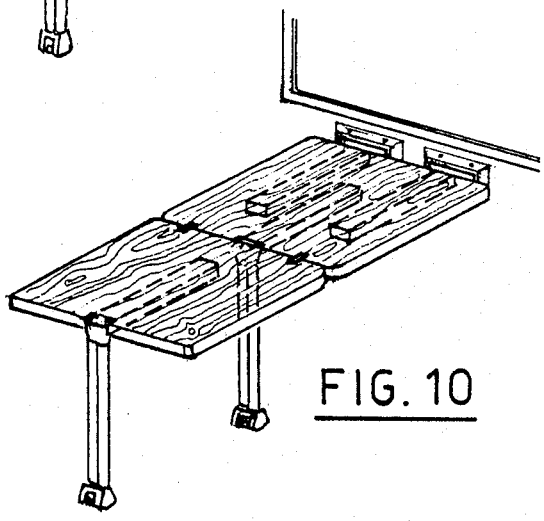
Figure 11:
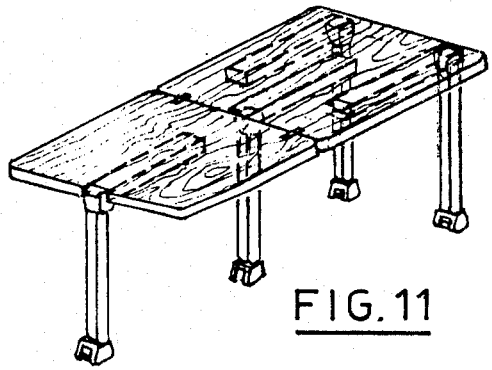
Figure 12:
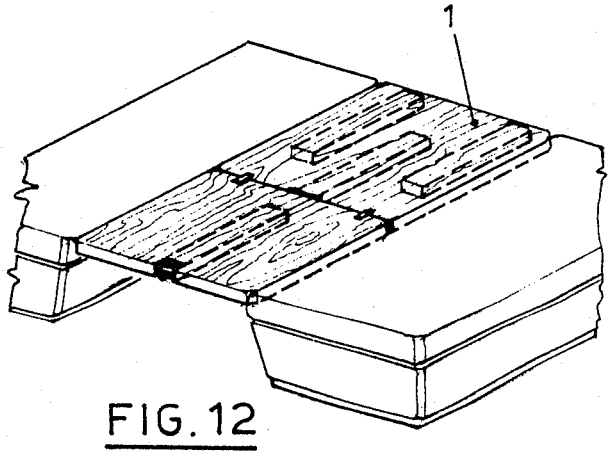
Figure 13:
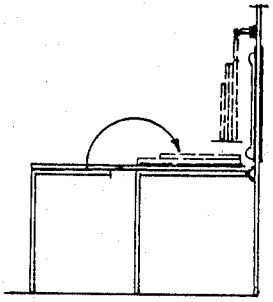
FIGS. 13 and 14 show the double table of FIGS. 7–12 in use (and in two possible ways when not in use).
Figure 14:
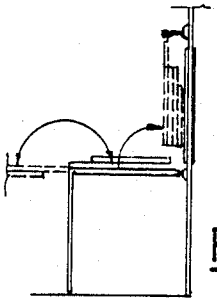
Figure 15:
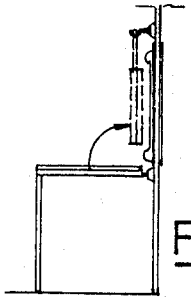
FIG. 15 shows the single table in use and not in use.
Figure 16:
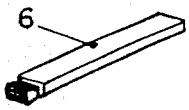
FIG. 16 shows one of the table legs in its track, for outside use of the table.
Figure 22:
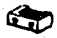
Figure 27:
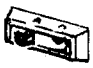
Figure 28:
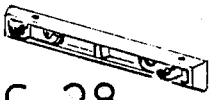
Figure 29:
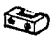
Figure 30:
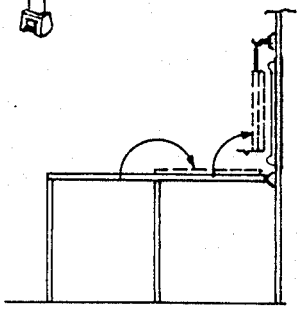
Figure 31:
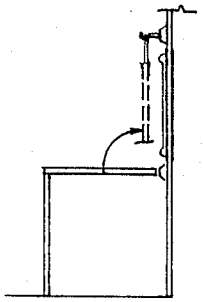
Figure 32:
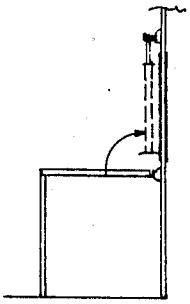
Figure 33:
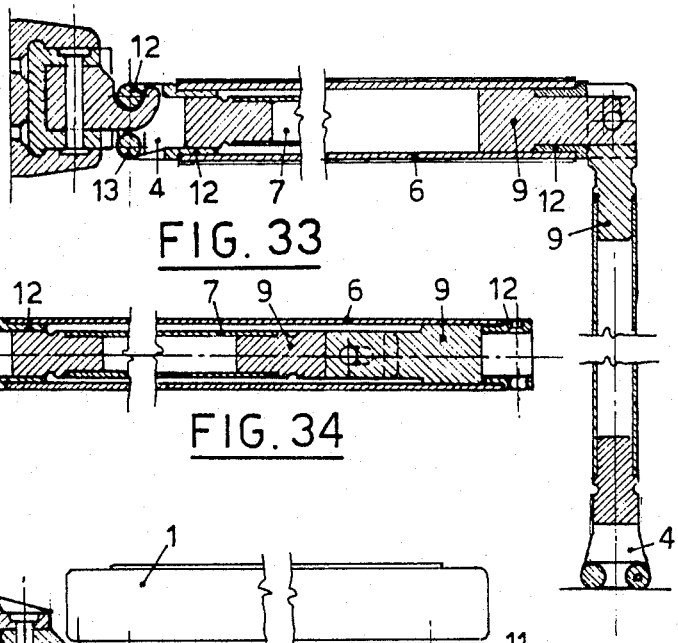
Figure 34:
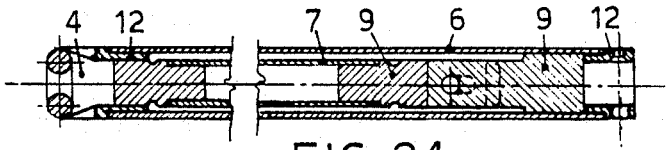
Figure 36:
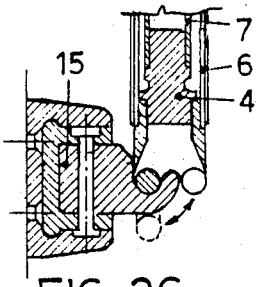
Figure 35:
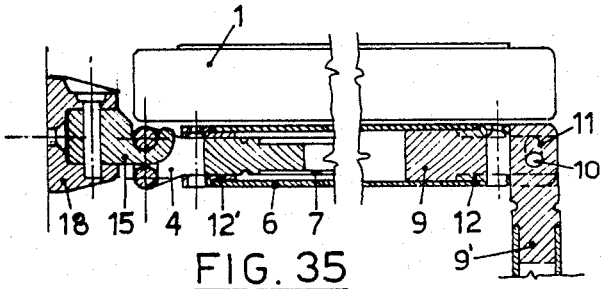
Figure 37:
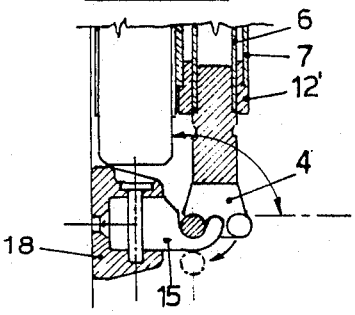
Figure 38:
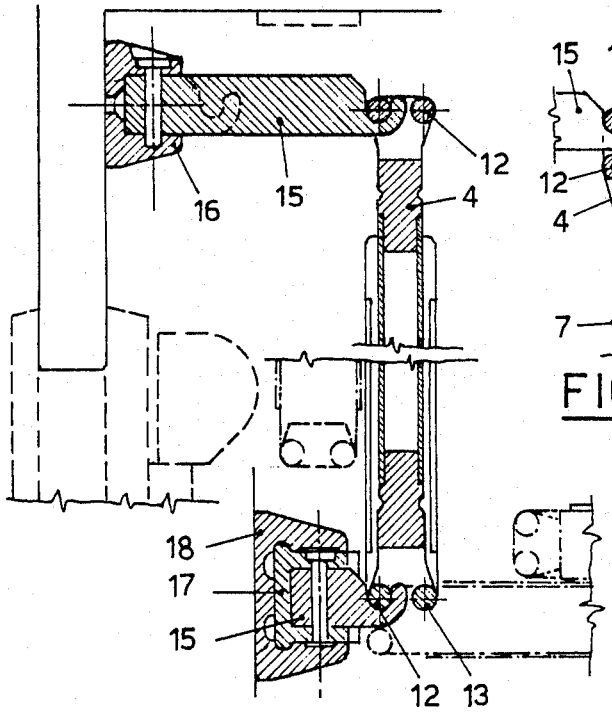
Figure 39:
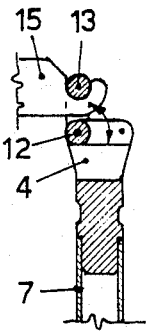
Figure 40:
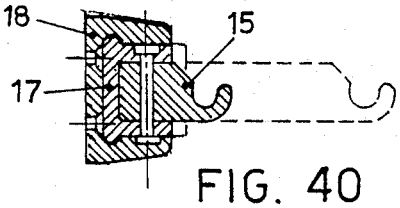
Figure 41:
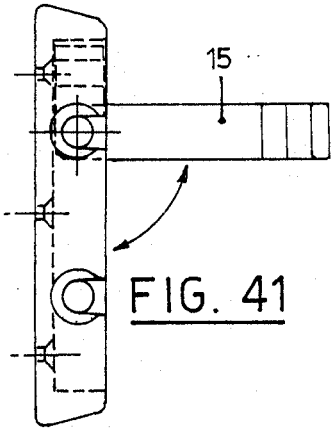
Figure 42:
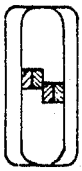

FIG. 22 shows the back support of the table to be used as shown in FIGS. 3 and 4 for the second and third leg;

FIGS. 23 to 32 shows similar views as previous shown, for inside use of the table;

FIG. 33 shows a cross-section of the table through its opposite legs, for internal use, in the use of the table;

FIG. 34 shows a cross-section of the leg for internal use of the table;

FIG. 35 shows a cross-view of the table from the two opposite legs on the outside in use;

FIGS. 36 and 37 respectively, show in sections the wall table folded vertically on its movable track and fixed supports, with its rotating safety fastener thus attached to each end of the leg;

FIG. 38 shows a cross-section of the table through two of the opposite legs during the folding maneuver to take the table out of its position of use, vertically appended to the wall support for the single size one, and with an extending device;

FIG. 39 shows a section of the table in its hanging position, with the rotating safety device thus with the inserted bolt (placed at the end of each table); and FIG. 40 shows a section of the double support for the sliding type with extending devices;

With reference to the said drawings and especially for FIGS. 1 thru 6, you must consider the table of FIG. 1 with its folding and adjustable legs 2 and 3. As you see in drawing 1, the table has three legs of which two (2) are set on one side, preferably the one that is anchored to the wall being one of them, and the third leg is on the opposite side. The legs in 2 and 3 to be more explicit later on, are made telescopically and fitted with 4 terminals suitable to be hooked up to a hanging support, (FIGS. 20, 27), or to wall bolts (FIGS. 21, 27, 28).

It is therefore possible to attach the table to the wall and the presence of the legs 2 and 3, allows for the use of table 1, either in an attached position or a free position from the wall, thus increasing its versatility.

On the other hand the table may easily be doubled in size and can be hinged together, and even 5 can be fastened together. In this case, as is shown in drawings FIGS. 8 to 15, the various views show the tables in non-used situation, folding one on top of the other, at the same time that the legs are folded into their cases as will be described further on.

It has been said that legs 2 and 3 are retractable and movable. For this purpose every leg 2,3 (FIGS. 16 to 19 and 23 to 26) is made of two parts eg. of an external case, sheath and track, 6 and the said leg, 7.

Figure 17:
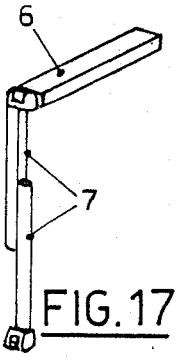
FIGS. 17 and 18 show a leg out of its track in use, both for an extendable leg and for a leg of fixed length.
Figure 18:
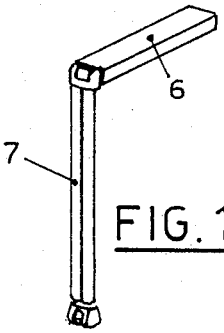
Figure 19:
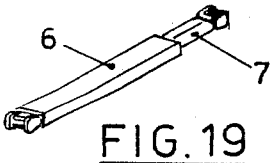
FIG. 19 shows a table leg partially out of its track.
Figure 24:
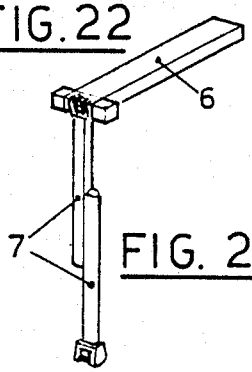
Figure 25:
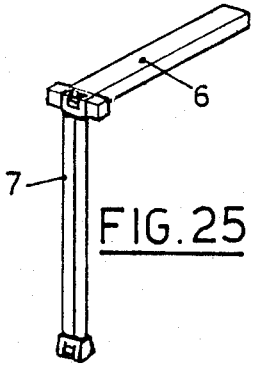

As per FIGS. 17, 18, 24, and 25, the leg 7 can be divided lengthwise in two parts, each being slidable with respect to each other and fixed in the manner shown in FIGS. 17 and 24, so that the length may be adjusted as desired or may remain in one piece (FIGS. 18 and 25) In the first illustration it is possible to shorten the length from the outer case, sheath or track, 6 while in the second illustration, as well as the height of the table from the floor, there is the added length of the case, 6.

The indicated leg 7 ends with bolt supports 4, at the outside of sheath 6 (see FIGS. 33 to 35), while its opposite end is fastened to a slide to be described below. The leg 7 can slide and be fitted into the track 6, as aforementioned, and can be located in the thickness of the table or may be left on the outside.

The slide has the dual purpose of guiding and putting the leg into track 6, and serves as a hinge because leg 7 can rotate on the same axle of track 6 or crosswise to it. For this the slide 9 is made up of two parts, 9' of which part 9 drawn into the track 6 ending with pivot 10, while 9' is fixed to leg 7 or a piece thereof, and ends at slot 11. The pivot 10, may be fitted with a lever lock that will hold it in place unless released, the reciprocal movements of the two parts 9',9. Supposing that leg 7 within its track 6, by applying pressure to terminal 4, is withdrawn from track 6, up to its end 9 of the slide can rotate around pivot 10, allowing rotation of leg 7 from its position within the sheath to a position perpendicular thereto. To attain the coupling of the pivot and the axle, the pivot, at the same time as the leg is being pulled, is held against the end of the slot facing the end of the leg, but after rotating the leg i.e. when table 1 is resting on said leg it will be in contact with said leg at the opposite end of the slot. This has a length, that upon its extension, the upper end of part 9' when pushed upward, the side of said part 9' will lean on the side of table 1 preventing any undesired rotation of the leg. In addition, the outer surface of the forked part of part 9' with pivot 10 are coneshaped to block, when leg 7 is in position of use, the sides shaped correspondingly of the coupling sleeve 12.

Only by sliding the pivot 10 within axle 11, will it be possible to change the angle of the leg with respect to the table. Moreover, track 6 ends with coupling 12' which constitutes the shoulder of part 9' of the coupling, and at the same time stop the withdrawal of the leg 7 from its track 6 which limits, for example, the separating of the table from the wall (see FIGS. 2 and 8). Naturally, the biggest separation is the full length of the leg.

It has been said that the free end of the leg ends with a fastening hook 4, at which ends there as affixed as best seen in FIGS. 33 to 39, two pivots 12 and 13 parallel to each other and with their axles properly separated. Hook 15 is located between them, to which the table must be anchored or hooked, with a hook bolted to the wall as appears in FIGS. 33, 35, 36, 37, 38. remaining fixed between pivot 12 upper, and lower pivot 13. The table 1 hence cannot move in a vertical direction but can be disengaged from hook 15 only by turning the upper pivot 12 around the axle. The outer side walls of the pivots 12 and 13 are made in such a way to fasten to leg 7 found in the table, to coupling 12' to prevent their release. An appropriate turn of the entire assembly of the pivot axle 12 is necessary to release leg 7.

The design of the terminal 4 allows for the vertical suspension of the table 1. Indeed, hooking up pivot 12 or 13 of both legs 2,3 respectively to the wall bolts 15, lower and upper, as seen in FIGS. 38 and 39, the table shall remain in a secure fixed horizontal position from which the release can be made only by a rotary movement and lifting that allows the unhooking of pivot 12 or 13 above hook 15. Naturally, the pivots of legs 2 shall be rotated upward or downward so that the table may be moved upward or downward respectively.

Mention has been made of the wall hooks 15 made to affix the table to the wall either in horizontal or vertical position. They are referred to in FIGS. 20, 21, 27, 28, 38, 39, 40 and 41 to show in greater detail these bolts 15.

Aside from the irrespective length of the hooks, depending on the distance from the wall to be used, hook 15 may be brought from a fixed base 16 (FIG. 38) or preferably from a movable base 17 (FIG. 40) located in the wall fixture. In the last case hook 15 can be made to slide within the case so that even the position of table 1 along the wall can be variable as in FIGS. 2, 3, 8 and 9 as shown by the traced lines. According to FIGS. 21 and 28 the support can be doubled to allow the use of hook 4 for both legs 2, thus allowing the attachment of table 1 to the wall with only one hooking operation.

As set forth previously, given that there are legs 2,3 in every table, and given the facility to unfasten the table from the wall, the table may be removed and used elsewhere from its usual location. Therefore, a support base, anchorable by bolts to terminal 4 of legs 2,3 in particular leg 3, allows greater stability to the table.

On the other hand, the use of three legs will provide increase in size of table 1 by hinging the end of one to the other as shown in FIGS. 8 to 12 and especially in FIGS. 13, 14, 15, 30, 31, 32 in which the traced lines show the probable blockage of the table in its suspended position, while the continuous lines show the table in use.

The improvements in tables that are bolted to the wall have been described and illustrated only for purpose of giving an illustration. Obviously, there shall be made such changes or additions that arise from considerations of technology, manufacture or suggestions from experts in the field within the scope of purposes of this effort.

I claim:

1. A table comprising:

a table member having a thickness defined by first and second opposed sides and an extent defined by first and second opposed ends, said first side being a generally flat surface;

at least three elongated tracks secured to said table member below said generally flat surface, each of said tracks having an open end, two of said tracks being positioned such that there open ends are adjacent said first end of said table member and one of said tracks being positioned such that its open end is positioned adjacent said second end of said table;

at least first, second and third legs movably positioned in said first, second and third tracks, respectively, each of said legs having a first end and a second end, said first end of each of said legs being disposed adjacent said open end of a respective track when a respective leg is retracted into a respective track, said second end of each of said legs being disposed adjacent said open end of a respective track when a respective leg is fully extended from a respective track; and pivoting means for pivoting coupling said second end of at least one of said legs to its respective track adjacent said open end of said respective track, said pivoting means being actuable only when said second end of said at least one leg is adjacent said open end of its track.

2. The table according to claim 1 including coupling means disposed at said first end of at least one of said legs for mounting said leg, and with it said table, to an object such as a wall.

3. The table according to claim 2 wherein at least one of said legs at its first end includes a slot extending longitudinally into said leg for receiving a hook, and engaging means for engaging said hook when in said slot.

4. The table according to claim 3 wherein said engaging means comprises two spaced cylinders defining an opening to said slot, said cylinders being sized to be received into a curved portion of said hook when said hook is disposed in said slot, said first end of said leg being structured such that when said hook is in said slot, said leg may be pivoted 90 degrees with respect to said hook with said cylinder remaining engaged with said hook.

5. The table according to claim 1 wherein at least one of said legs includes at least two juxtaposed and relatively movable sections, the table including means for fixing the sections relative to each other to thereby fix the overall length of said at least one leg.

6. The table according to claim 1 wherein said pivoting means comprises a slide member, said slide member and its respective track being configured for slidable movement of said slide member in said respective track, a pivot pivotally coupling said slide member to said second end of said leg, and a stop associated with said respective track for preventing withdrawal of said slide member from said respective track through said open end of said respective track.

* * * * *